US006874619B1

(12) United States Patent
Hawkes

(10) Patent No.: US 6,874,619 B1
(45) Date of Patent: Apr. 5, 2005

(54) JEWELRY DISPLAY ASSEMBLY

(76) Inventor: James M. Hawkes, 100 S. Prospectors, Apache Junction, AZ (US) 85219

( * ) Notice: Subject to any disclaimer, the term of this patent is extended or adjusted under 35 U.S.C. 154(b) by 169 days.

(21) Appl. No.: 10/268,403

(22) Filed: Oct. 10, 2002

(51) Int. Cl.[7] ..... B65D 6/04; A45C 11/04

(52) U.S. Cl. ..... 206/6.1; 206/566; 206/564; 206/499; 211/85.2

(58) Field of Search ..... 206/499, 509, 206/557, 486, 6.1, 561–566; 211/85.2

(56) References Cited

U.S. PATENT DOCUMENTS 480,045 A * 8/1892 Sommer ..... 206/566
3,942,632 A * 3/1976 Witkoff ..... 206/45.2
4,432,456 A * 2/1984 Ovadia et al. ..... 206/566
4,646,920 A * 3/1987 Kruger ..... 211/85.2
4,923,069 A 5/1990 Germain et al.
4,993,545 A * 2/1991 Feiler ..... 206/6.1
5,062,526 A * 11/1991 Rudnick et al. ..... 206/6.1
5,535,878 A * 7/1996 Reed ..... 206/6.1
5,600,937 A 2/1997 Erickson et al.
5,641,061 A 6/1997 Muylder-Braun
6,056,130 A 5/2000 Ovadia

* cited by examiner

*Primary Examiner*—Jila M. Mohandesi
(74) *Attorney, Agent, or Firm*—John D. Lister

(57) ABSTRACT

A jewelry display assembly includes jewelry display pad(s), a display base, and a display tray. The display base has an upper surface with a slot therein for receiving and removably retaining the lower edge portion of any of the assembly's jewelry display pads. The slot is inclined at an angle to the vertical to better display jewelry mounted on the front surface of a jewelry display pad mounted in the display base. The resilience of the jewelry display pads helps to hold the display pads in the slot and to retain the initial appearance of the pads after their removal from the slot in the display base. The display tray holds a plurality of the jewelry display pads from which display pads can be selected for better display by mounting in the display base.

7 Claims, 1 Drawing Sheet

28
22
24
28
22
28
22
22
28
36
26
38
40
20

22

34
30
32

30°-60°
40
26
38

JEWELRY DISPLAY ASSEMBLY

BACKGROUND OF THE INVENTION

The subject invention relates to a jewelry display assembly and in particular to a jewelry display assembly having a display base that is inexpensive, aesthetically pleasing, and easily used to individually display items of jewelry that are mounted on jewelry display pads to better advantage for examination by potential customers or other interested parties.

Jewelry artisans and manufactures selling jewelry to representatives of retail jewelry outlets at jewelry shows and conventions often individually mount their items of jewelry on jewelry display pads and store, transport and display the jewelry on these display pads to potential customers and other interested parties in storage and display trays holding a relatively large number of jewelry display pads. While these storage and display trays are well suited for storing and transporting items of jewelry mounted on jewelry display pads, the display of items of jewelry in these or similar trays has several drawbacks. First, since the trays have a relatively large number of items of jewelry on display in close proximity to each other, it is more difficult for a jeweler to prominently display a particular item of jewelry he/she wishes to promote or otherwise have potential customers or other interested parties focus on. Secondly, the jewelry display pads are horizontally housed within the compartments of the jewelry storage and display trays thereby making the items of jewelry less visible at a distance to potential customers or other interested parties to attract the potential customers and other interested parties to the jewelers display. In addition, to the need to individually display items of jewelry mounted on jewelry display pads to potential customers and other interested parties at jewelry shows and conventions, there also is a need for individually presenting jewelry mounted on jewelry display pads to customers of retail outlets.

SUMMARY OF THE INVENTION

A jewelry display assembly of the subject invention provides an inexpensive, aesthetically pleasing and easy to use display base for individually displaying items of jewelry mounted on jewelry display pads to both retailers and their customers. The jewelry display assembly of the subject invention includes jewelry display pad(s), a storage and display tray, and a display base. Typically, the storage and display tray of the assembly holds a plurality of the jewelry display pads from which jewelry on a jewelry display pad can be selected for individual and better display by mounting the jewelry display pad in the display base. The display base has an upper surface with a slot therein for receiving and removably retaining the lower edge portion of any of the assembly's jewelry display pads so that the jewelry on the jewelry display pads can be individually displayed and examined. The slot in the display base is inclined at an angle to the vertical to better display jewelry mounted on the front surface of a jewelry display pad mounted in the display base to persons viewing the jewelry from a distance or viewing the jewelry form a location immediately in front and above the jewelry, (e.g. when the display base is located on counter or table). When one of the jewelry display pads is mounted in the slot of the display base, the resilience of the jewelry display pad helps to removably hold the jewelry display pad in the slot.

In order to display jewelry to its best advantage, the jewelry display pads are normally designed to provide rich, aesthetically pleasing backgrounds for the jewelry being displayed. Thus, it is important that the lower edge portions of the jewelry display pads, rather than retaining a crease, recover to their initial appearance after their removal from the slot in the display base for placement back in the display tray or for handling to permit a closer inspection of the jewelry. Preferably, the width of the slot in the display base relative to the thickness of the jewelry display pads is set to assure that the display pads are not over compressed and that the resilience of the jewelry display pads causes the jewelry display pads to recover to their initial uncreased shape after removal from the display base to thereby retain their initial aesthetically pleasing appearance.

DESCRIPTION OF THE PREFERRED EMBODIMENTS

Figure 1:
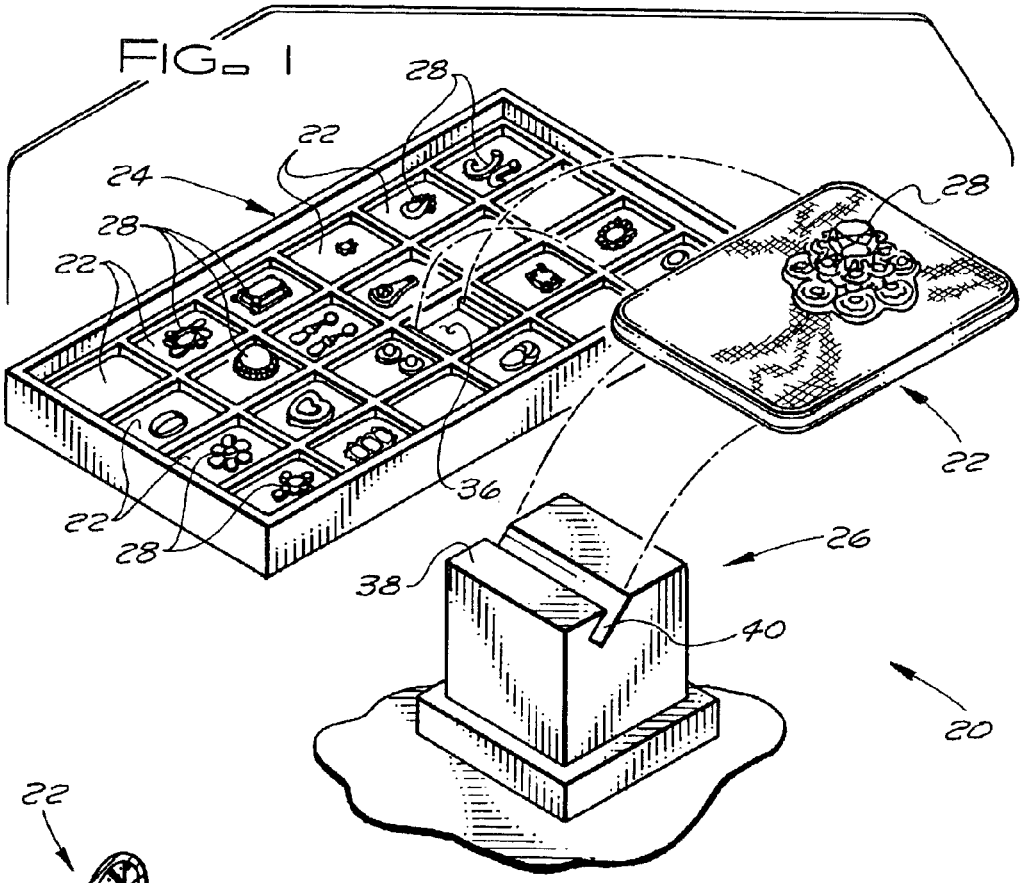
FIG. 1 is a perspective view of the jewelry display assembly of the subject invention with showing one of the jewelry display pads in the process of being removed from the display tray and inserted into the display base.
Figure 2:
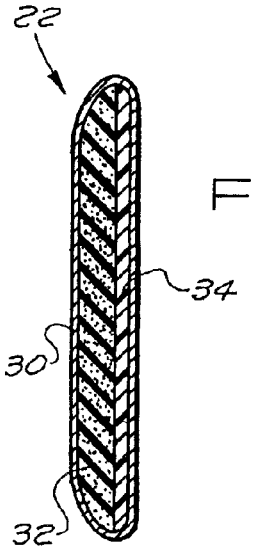
FIG. 2 is a vertical transverse cross section through a jewelry display pad of the subject invention.

As shown in FIG. 1, the jewelry display assembly 20 of the subject invention includes jewelry display pad(s) 22, a jewelry storage and display tray 24, and a display base 26. The jewelry display pads 22 have various items of jewelry 28 mounted thereon, such as but not limited to earrings, broaches, rings, pendants, etc., and the display pads with the mounted jewelry are normally stored, transported and displayed in the display tray 22. The display base 26 is used in conjunction with the jewelry display pads 22 to individually display jewelry mounted on any of the jewelry display pads.

The jewelry display pads 22 typically have a cover layer 30, such as but not limited to a leather, imitation leather, or satin or silk appearing cover layer of an appropriate color for the item of jewelry being displayed. The cover layer 30 provides a rich looking and aesthetically pleasing background for displaying the items of jewelry 28 mounted on the jewelry display pads. Typically, the jewelry display pads 22 are resilient, can be compressed from a first uncompressed thickness to a second reduced thickness, and, when compressive forces are released, will recover to their first uncompressed thickness and regain their original aesthetic appearance. A typical jewelry display pad 22 that can be used in the jewelry display assembly 20 of the subject invention is a generally rectangular pad that includes the cover layer 30, a resilient front layer 32, and a rigid backing or support layer 34 that is overlaid by the resilient front layer. The resilient front layer 32 provides a foundation behind the cover layer 30 through which fasteners mounting the items of jewelry on the front major surfaces of jewelry display pads can pass. The resilient front layer 32 of this type of pad can be compressed from an uncompressed state to a compressed state of reduced thickness and then recover to its initial thickness. The cover layer 30 overlays and envelops the resilient front layer 32 and the rigid backing layer 34 and may be used to secure the resilient front layer 32 to the rigid backing layer 34.

The jewelry storage and display tray 24 includes a plurality of upwardly open compartments 36 that receive and house the jewelry display pads 22 for storage, transportation, and display. A typical jewelry storage and display tray 24 may have about twenty-four compartments to house twenty-four jewelry display pads and the items of jewelry mounted on the jewelry display pads. While these trays are quite convenient for the storage and transportation of the jewelry mounted on the jewelry display pads, the jewelry storage and display trays 24 have several drawbacks relating to the display of jewelry to potential customers and other interested parties. First, since the trays have a relatively large number of items of jewelry on display in close proximity to each other, it is more difficult for a jeweler to prominently display a particular item of jewelry he/she wishes to promote or otherwise have potential customers or other interested parties focus on. Secondly, the jewelry display pads are horizontally housed within the compartments of jewelry storage and display tray 24 thereby making the items of jewelry less visible to potential customers or other interested parties unless the items of jewelry are being viewed from directly above the tray.

Figure 3:
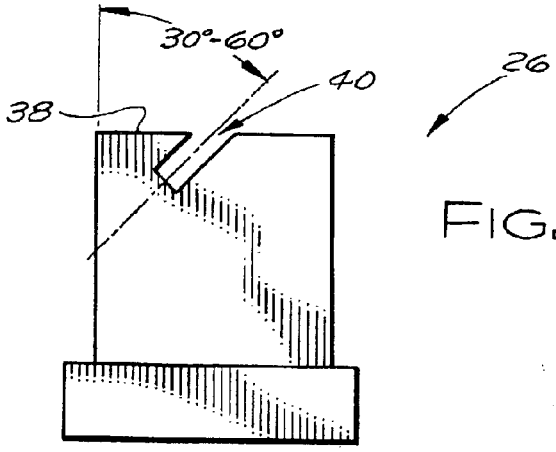
FIG. 3 is a side view of a display base of the subject invention.

As discussed above in the summary of the invention, the display base 20 of the subject invention solves the drawbacks associated with displaying jewelry in the jewelry storage and display trays 24 or similar trays. As shown in FIGS. 1 and 3, the body of the display base 26 is in the form of a block (e.g. a one inch square block bonded or otherwise secured to a one and one quarter inch square base plate). While the display base 26 is shown as a block, the display base 26 may take other shapes provided the selected shape forms a stable base for mounting the jewelry display pads 22. The display base 26 may be made of wood, polyethylene or some other polymeric material that can be easily molded to the desired shape, metal, or other suitable materials. The display base 26 has an upper surface 3B with a slot 40 therein for receiving and removably retaining the lower edge portion of any of the assembly's jewelry display pads 22 so that the items of jewelry 28 on the jewelry display pads can be individually and prominently displayed and individually examined. The slot 40 in the display base 28 is inclined at an angle to the vertical to better display the item of jewelry 28 mounted on the front surface of a jewelry display pad 22 mounted in the display base 26 to persons viewing the jewelry from in front and above, (e.g. when the display base is located on counter or table). Preferably, as best shown in FIG. 3, the slot 40 is inclined at an angle to the vertical that is between 30° and 60° and most preferably at an angle to the vertical of about 45°; the slot 40 is open at the too end and closed at the bottom end; and the width of the slot 40 between opposed sidewall surfaces of the slot is constant throughout the depth of the slot. The width of the slot 40 is less than the uncompressed thickness of the jewelry display pads 22 so that the lower edge portion of a jewelry display pad 22 inserted into the slot 40 win be compressed. When one of the jewelry display pads 22 is mounted in the slot 40, the resilience of the jewelry display pad 22 helps to removably hold the jewelry display pad securely in the slot. As discussed above, in order to display an item of jewelry to its best advantage, the jewelry display pads are designed to provide rich, aesthetically pleasing backgrounds for the jewelry being displayed. Thus, ft is important that the lower edge portions of the jewelry display pads 22, rather than retaining a crease, recover to their appearance after their removal from the slot 40 in the display base 26 for placement back in the storage and display tray 24 or for handling to permit a closer inspection of the jewelry. The width of the slot 40 relative to the thickness of the jewelry display pads 22 is set to assure that the pads 22 are not over compressed and that the resilience of the jewelry display pads 22 causes the jewelry display pads to recover to their initial uncreased shape after removal from the display base 26 to thereby retain their initial aesthetically pleasing appearance.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A jewelry display assembly comprising:

a generally resilient jewelry display pad having a front major surface upon which jewelry is mounted for display, a back major surface, and a first uncompressed thickness extending from the front major surface to the back major surface; the resilient jewelry display pad being compressible from the first thickness in the uncompressed state to a second reduced thickness in a compressed state from which the resilient display pad recovers to the first thickness when no longer subjected to compressive stresses; and a display base, the display base having an upwardly open slot in an upper surface for receiving a lower edge portion of the jewelry display pad; the upwardly open slot extending at an angle between 30° and 60° to the vertical; the upwardly open slot having an open upper end, a closed bottom end, a width, and a depth; the width of the slot for at least a substantial portion of the depth of the slot, which extends from the open upper end of the slot toward the closed bottom end of the slot and which receives the lower edge portion of the jewelry display pad, being substantially constant and less than the first thickness of the jewelry display pad whereby when the lower edge portion of the jewelry display pad is inserted into the slot with the front major surface in contact with a first surface of the slot and the back major surface in contact with a second opposed surface of the slot, the slot compresses the lower edge portion of the jewelry display pad to the second reduced thickness of the jewelry display pad to secure the jewelry display pad to the display base with the front major surface of the jewelry display pad extending from the slot at an angle between 30° and 60° to the vertical that is substantially equal to the angle of the slot to the vertical.

2. The jewelry display assembly according to claim 1, including:

a display tray; a plurality of the jewelry display pads; the display tray having a plurality of upwardly open compartments in an upper surface of the tray for receiving the jewelry display pads; and the jewelry display pads being housed in the upwardly open compartments of the display tray whereby any of the jewelry display pads can be selected from the display tray and inserted into the slot of the display base with the front major surface upon which jewelry is mounted to be displayed facing upward at an angle between 30° and 60° to the vertical for displaying jewelry.

3. The jewelry display assembly according to claim 2, wherein:

the jewelry display pads each have a resilient front layer and forces generated by the resilience of the resilient front layer of any of the jewelry display pads inserted into and compressed within the slot of the display base helps to securely but removably retain the inserted jewelry display pad in the slot of the display base.

4. The jewelry display assembly according to claim 2, wherein:

the jewelry display pads each have a resilient front layer and the resilience of the resilient front layer of any of the jewelry display pads inserted into the slot in the display base causes the jewelry display pad inserted into the display base to recover to the first thickness and an initial appearance after removal from the slot in the display base.

5. The jewelry display assembly according to claim 1, wherein:

the jewelry display pad has a resilient front layer and forces generated by the resilience of the resilient front layer of the jewelry display pad when the jewelry display pad is inserted into and compressed within the slot helps to securely by removably retain the jewelry display pad within the slot.

6. The jewelry display assembly according to claim 1, wherein:

the jewelry display pad has a resilient front layer and the resilience the front layer causes the jewelry display pad to recover to the first thickness and an initial appearance after the jewelry display pad has been inserted into and removed from the slot in the display base.

7. The jewelry display assembly according to claim 1, wherein:

the resilient jewelry display pad comprises a resilient front layer overlaying a rigid backing layer; the resilient jewelry display pad has the first thickness with the resilient front layer in an uncompressed state and the second reduced thickness with the resilient front layer in a compressed state; the resilient front layer and rigid backing layer are enveloped within an aesthetic covering layer; and the resilience the front layer causes the jewelry display pad to recover to the first thickness and an initial appearance after the jewelry display pad has been inserted into and removed from the slot in the display base.

* * * * *